US009495839B2

(12) United States Patent
Aoki et al.

(10) Patent No.: US 9,495,839 B2
(45) Date of Patent: Nov. 15, 2016

(54) WAGERING GAME WITH REEL ARRAY HAVING EXTENDED SYMBOL VISUALLY OVERLAYING ADJACENT REEL

(71) Applicant: WMS Gaming Inc., Waukegan, IL (US)

(72) Inventors: Dion K. Aoki, Chicago, IL (US); Shawn C. Collette, Henderson, NV (US); Jeremy M. Hornik, Chicago, IL (US); Pamela S. Smith, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 13/783,273

(22) Filed: Mar. 2, 2013

(65) Prior Publication Data

US 2013/0324213 A1 Dec. 5, 2013

Related U.S. Application Data

(60) Provisional application No. 61/652,525, filed on May 29, 2012.

(51) Int. Cl.
*G07F 17/32* (2006.01)
*G07F 17/34* (2006.01)

(52) U.S. Cl.
CPC ..... *G07F 17/326* (2013.01); *G07F 17/3213* (2013.01); *G07F 17/34* (2013.01)

(58) Field of Classification Search
CPC ..... A63F 9/24
USPC ..... 463/16–21
See application file for complete search history.

(56) References Cited

U.S. PATENT DOCUMENTS

| | | | | |
|---|---|---|---|---|
| 6,375,570 | B1 * | 4/2002 | Poole | 463/31 |
| 6,896,615 | B2 * | 5/2005 | Berman | 463/20 |
| 7,326,113 | B2 * | 2/2008 | Bennett et al. | 463/25 |
| 8,382,570 | B2 * | 2/2013 | Bennett | 463/20 |
| 2002/0047238 | A1 | 4/2002 | Ainsworth et al. | 273/292 |
| 2004/0033827 | A1 * | 2/2004 | Gilmore et al. | 463/20 |
| 2005/0049030 | A1 * | 3/2005 | Tachikawa | 463/20 |
| 2005/0266915 | A1 * | 12/2005 | Isogai et al. | 463/20 |
| 2007/0026933 | A1 * | 2/2007 | Tanimura | 463/20 |
| 2007/0066391 | A1 * | 3/2007 | Kojima | 463/31 |
| 2007/0238510 | A1 * | 10/2007 | Halprin | 463/20 |
| 2008/0108411 | A1 * | 5/2008 | Jensen et al. | 463/20 |
| 2008/0108414 | A1 * | 5/2008 | Stevens et al. | 463/20 |

(Continued)

OTHER PUBLICATIONS

Patent Examination Report No. 1 for Australian Application No. 2013202627 dated Sep. 11, 2014 (2 pages).

*Primary Examiner* — Jason Skaarup
(74) *Attorney, Agent, or Firm* — Nixon Peabody LLP

(57) ABSTRACT

A gaming system includes an input device, a display device, a processor, and a memory device. The memory device stores instructions that, when executed by the processor, cause the gaming system to receive a wager and to display an array having a plurality of symbol positions, each of the symbol positions being populated by symbols located on a plurality of symbol-bearing reels. The reels spin and stop to place symbols on the symbol-bearing reels in visual association with symbol positions of the array. At least one extended symbol indexed on a first reel visually overlaps one or more symbols on an adjacent second reel (a) as the first reel spins the extended symbol through the array and (b) without affecting a stopping position of the adjacent second reel. An award is awarded for any winning combinations defined by the symbols in the display area.

20 Claims, 9 Drawing Sheets

(56) References Cited

U.S. PATENT DOCUMENTS

| | | | | |
|---|---|---|---|---|
| 2008/0132322 | A1* | 6/2008 | Yoshizawa | 463/20 |
| 2008/0139294 | A1* | 6/2008 | Inamura | 463/20 |
| 2008/0146319 | A1* | 6/2008 | Yoshizawa | 463/21 |
| 2009/0061984 | A1* | 3/2009 | Yi | 463/20 |
| 2009/0117983 | A1* | 5/2009 | Visser | 463/20 |
| 2009/0227338 | A1* | 9/2009 | Yoshizawa | 463/20 |
| 2011/0117987 | A1* | 5/2011 | Aoki et al. | 463/20 |
| 2011/0117993 | A1* | 5/2011 | Carlson et al. | 463/20 |
| 2011/0201406 | A1* | 8/2011 | Jaffe et al. | 463/21 |
| 2011/0223985 | A1* | 9/2011 | Mizue | G07F 17/34 463/20 |
| 2012/0157181 | A1* | 6/2012 | Jensen et al. | 463/20 |
| 2012/0190438 | A1* | 7/2012 | Bartosik et al. | 463/31 |
| 2013/0122988 | A1* | 5/2013 | Guinn et al. | 463/20 |
| 2014/0087830 | A1* | 3/2014 | Gobe | G07F 17/3213 463/20 |

* cited by examiner

WAGERING GAME WITH REEL ARRAY HAVING EXTENDED SYMBOL VISUALLY OVERLAYING ADJACENT REEL

CROSS-REFERENCE TO RELATED APPLICATIONS

This application claims the benefit of and priority to U.S. Provisional Patent Application No. 61/652,525, titled "Wagering Game With Reel Array Having Extended Symbol Visually Overlaying Adjacent Reel" and filed on May 29, 2012, which is incorporated herein by reference in its respective entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a reel array with an extended symbol for a wagering game.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

Traditionally, gaming machines operate under control of a processor that has been programmed to execute base games and bonus games in which reel arrays spin and stop to display symbol combinations in a display area. If winning combinations are achieved by the symbol combinations, awards are provided to the players.

SUMMARY OF THE INVENTION

According to one aspect of the present invention, a gaming system includes an input device, a display device, a processor, and a memory device. The memory device stores instructions that, when executed by the processor, cause the gaming system to receive a wager and to display an array having a plurality of symbol positions, each of the symbol positions being populated by symbols located on a plurality of symbol-bearing reels. The reels spin and stop to place symbols on the symbol-bearing reels in visual association with symbol positions of the array. At least one extended symbol indexed on a first reel visually overlaps one or more symbols on an adjacent second reel (a) as the first reel spins the extended symbol through the array and (b) without affecting a stopping position of the adjacent second reel. An award is awarded for any winning combinations defined by the symbols in the display area.

According to another aspect of the invention, a computer-implemented method in a gaming system includes receiving a wager in response to an input via at least one input device, and displaying on at least one display device an array comprising a plurality of symbol positions, each of the symbol positions being populated by symbols located on a plurality of symbol-bearing reels including at least a first reel and a second reel adjacent to the first reel. The first reel includes at least one extended symbol indexed thereon. The method further includes spinning and stopping, by one or more processors, the symbol-bearing reels to place symbols on the symbol-bearing reels in visual association with the symbol positions of the array. The at least one extended symbol on the first reel is displayed visually overlapping one or more symbols on the adjacent second reel (a) as the first reel spins the extended symbol through the array and (b) without affecting a stopping position of the adjacent second reel. An award is awarded, by at least one of the one or more processors, for any winning combinations defined by the symbols in the display area.

According to yet another aspect of the invention, one or more machine-readable non-transitory storage media included instructions which, when executed by one or more processors, cause the one or more processors to perform operations including receiving a wager in response to an input via at least one input device, and displaying on at least one display device an array comprising a plurality of symbol positions, each of the symbol positions being populated by symbols located on a plurality of symbol-bearing reels including at least a first reel and a second reel adjacent to the first reel. The first reel includes at least one extended symbol indexed thereon. The operations further include spinning and stopping the symbol-bearing reels to place symbols on the symbol-bearing reels in visual association with the symbol positions of the array. The at least one extended symbol on the first reel is displayed visually overlapping one or more symbols on the adjacent second reel (a) as the first reel spins the extended symbol through the array and (b) without affecting a stopping position of the adjacent second reel. An award is awarded for any winning combinations defined by the symbols in the display area.

Additional aspects of the invention will be apparent to those of ordinary skill in the art in view of the detailed description of various embodiments, which is made with reference to the drawings, a brief description of which is provided below.

Figure 1:
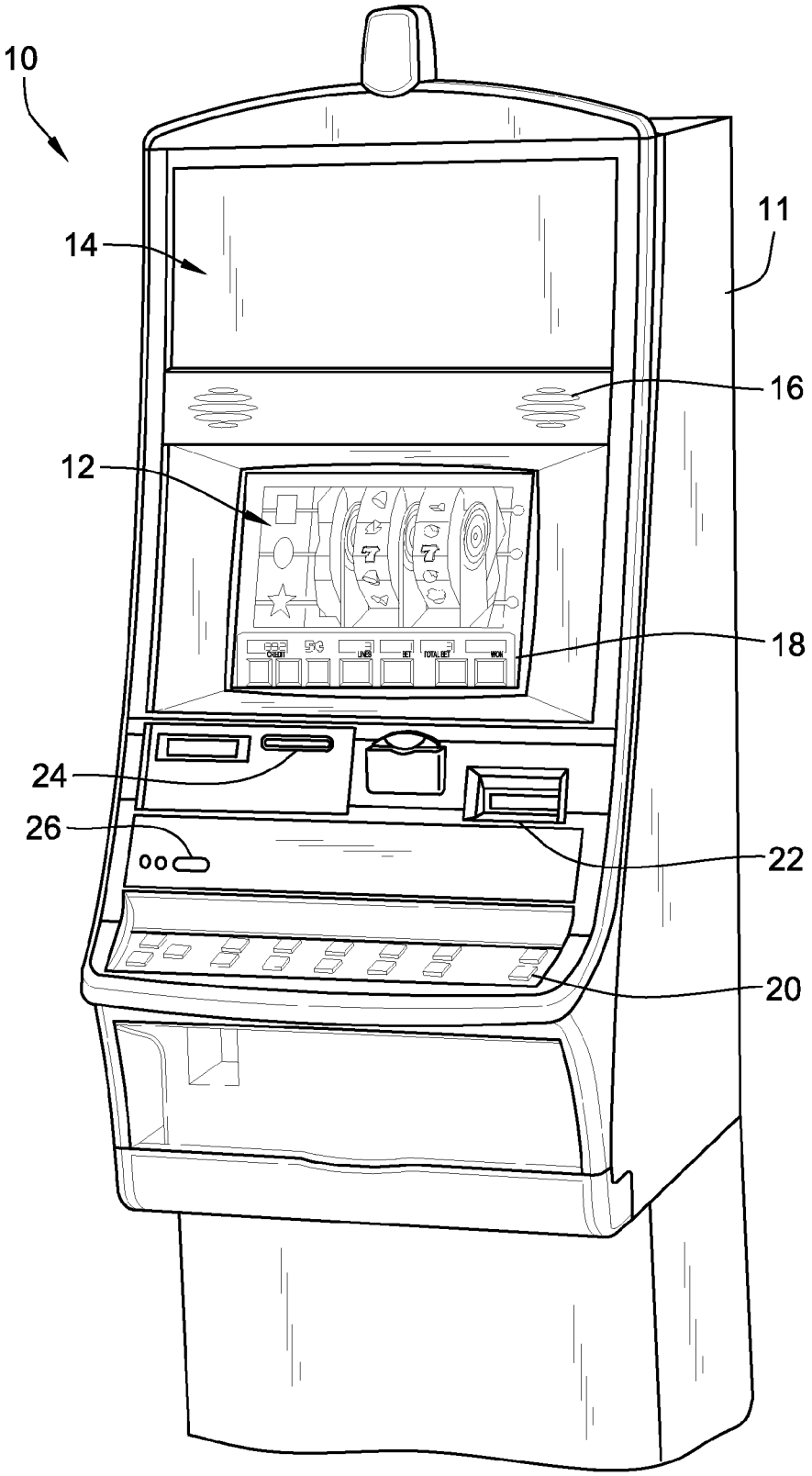
FIG. 1 (PRIOR ART)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
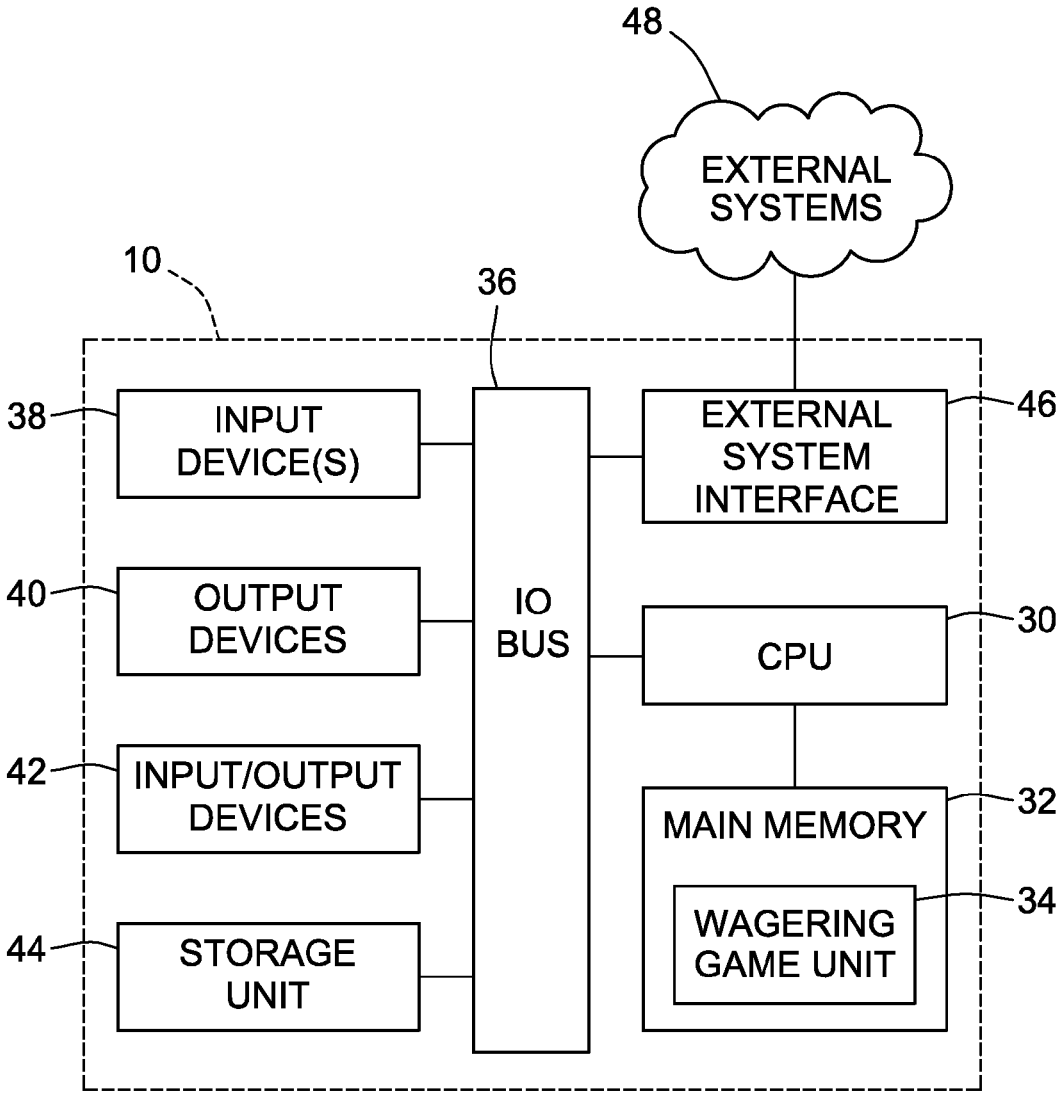
FIG. 2 (PRIOR ART)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
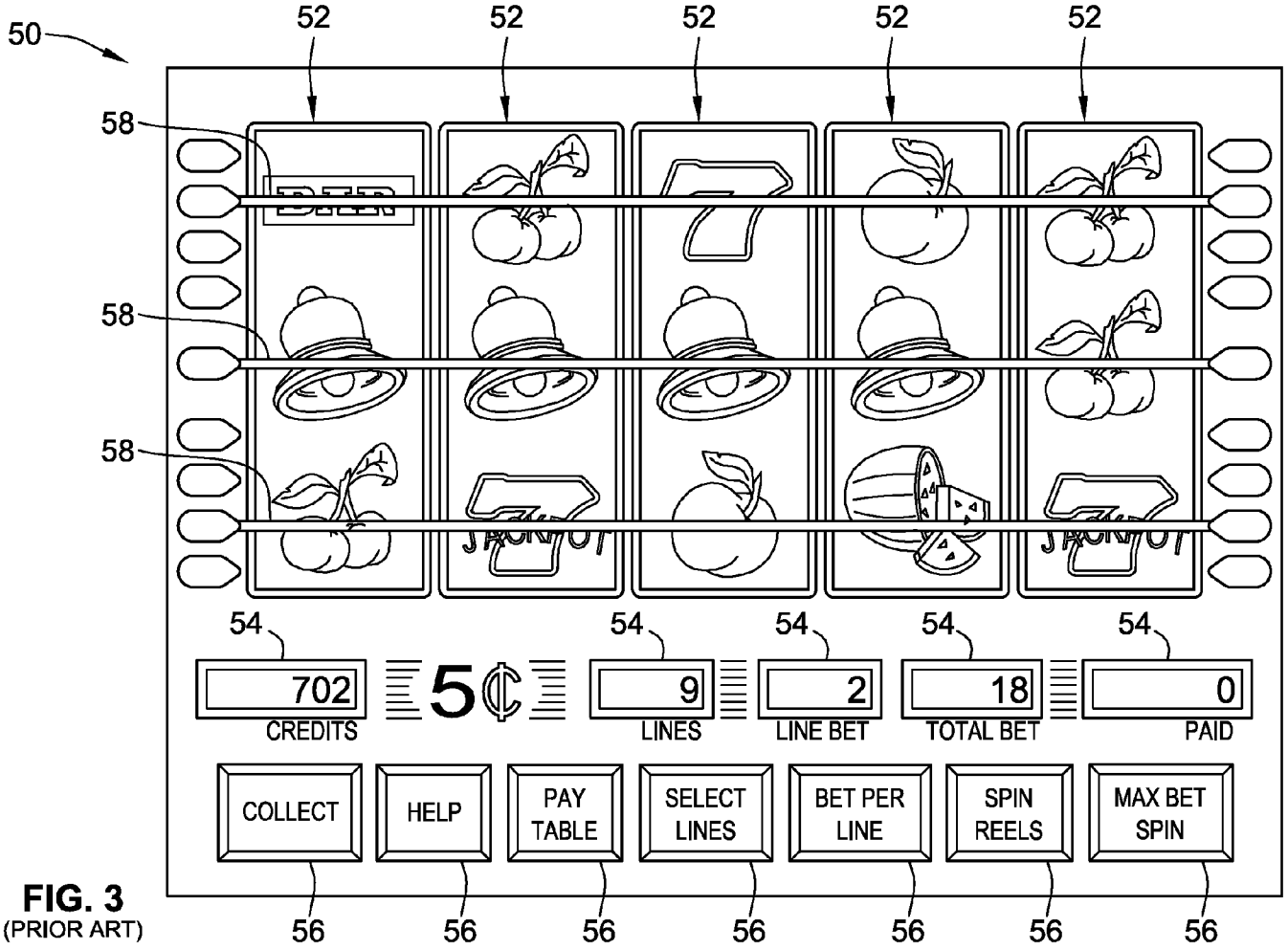
FIG. 3 (PRIOR ART)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Referring now to FIGS. 4A-4D, an image of a game screen 150 is adapted to be displayed on a display area of the primary display area 12 or the secondary display area 14. The game screen 150 portrays a plurality of symbol-bearing reels 152A-152E having a plurality of symbols 154 and extended (or oversized) symbols 156A, 156B. The reels 152A-152E include a leftmost first reel 152A, which is adjacent to a second reel 152B. The second reel 152B is adjacent to a central third reel 152C, which is adjacent to a fourth reel 152D. The fourth reel 152D is adjacent to a rightmost reel 152E. The plurality of symbol-bearing reels 152A-152E form a five-by-three array 151 (i.e., five reels, each three symbol positions high). As illustrated, the five-by-three array includes fifteen unique, individual array positions.

The plurality of symbols 154 are symbols associated with respective dedicated symbol positions of respective reels, and each occupy a single array position when displayed within the array 151 upon the reels coming to rest. For example, a "C" symbol of the third reel 152C is illustrated currently spinning through a top position of the array 151, an "F" symbol of the third reel 152C is illustrated currently spinning through a middle position of the array 151, and an "A" symbol of the third reel 152C is illustrated currently spinning through a bottom position of the array 151. As such, each of the symbols 154 and extended symbols 156A, 156B is spinning through top, middle, and bottom array positions of the five-by-three array.

The extended symbols 156A, 156B are symbols associated with multiple positions of the array 151. Each of the extended symbols 156A, 156B has an index position on only one of the reels 152A-152E, meaning that only a single reel moves the extended symbol through the array 151. For example, in reference to FIG. 4A, a first extended symbol 156A on the first reel 152A is currently moving generally through three positions: (a) the top position of the first column of the array 151, (b) the middle position of the first column of the array 151, and (c) the top position of the adjacent second column of the array 151. The first extended symbol 156A has three "A" images that are clumped in a sideway "T-shape" to visually overlap each of the three positions. Eventually, as shown in FIG. 4B, the first extended symbol 156A is randomly selected to stop and visually overlap (a) the middle position of the first column of the array 151, (b) the bottom position of the first column of the array 151, and (c) the middle position of the adjacent second column of the array 151.

In general, the first reel 152A is referred to as a superclump reel, which is associated with a different layer than the adjacent second reel 152B. In some embodiments, only the extended symbols 156A, 156B sit at a higher layer than adjacent reels. In other embodiments, the extended symbols may sit at a variety of different layers such that a first extended symbol on the leftmost reel may sit atop an extended symbol on the second, adjacent reel, whereas a second extended symbol on the leftmost reel may sit beneath (and therefore have a portion of its overlap negated by) an extended symbol on the second, adjacent reel. For example, the first reel 152A, or extended symbol 156A, is located on a visual layer above the second reel 152B. The superclump reel can be a Wild superclump reel in which all the symbols are evaluated as Wild symbols. Optionally, one or more roaming Wild symbols or Wild reels can be evaluated in a layer above or below the superclump reel. Optionally yet, left-to-right scatter symbols are included on the superclump reel.

The first extended symbol 156A extends from, and is controlled by, the first reel 152A because its index position has been assigned to the first reel 152A, as discussed above. As such, the first extended symbol 156A spins and stops with the first reel 152A, independent of the other reels 152B-152E.

Figure 4A:
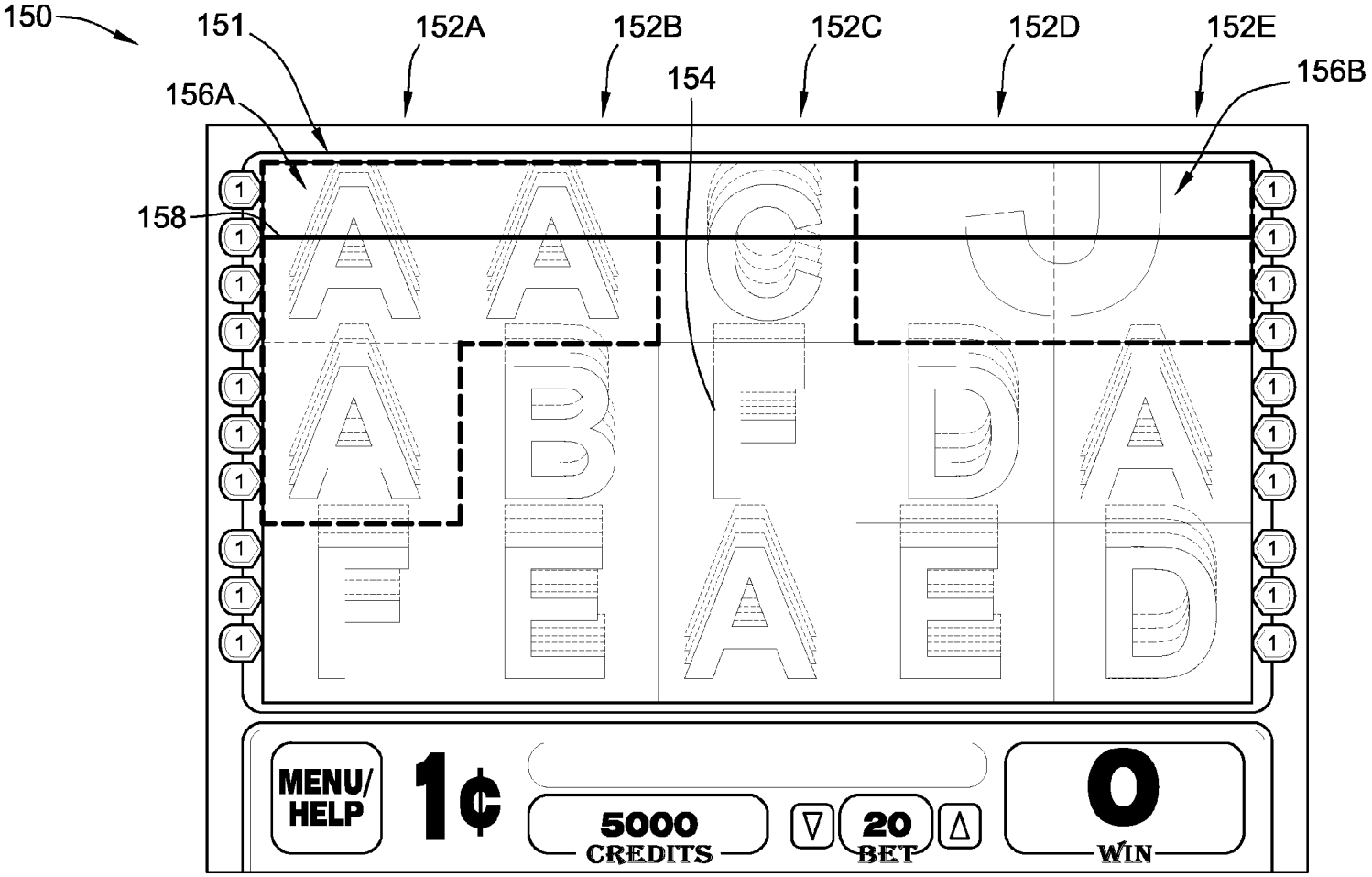
FIG. 4A is an image of a game screen displaying spinning reels for a wagering game.
Figure 4B:
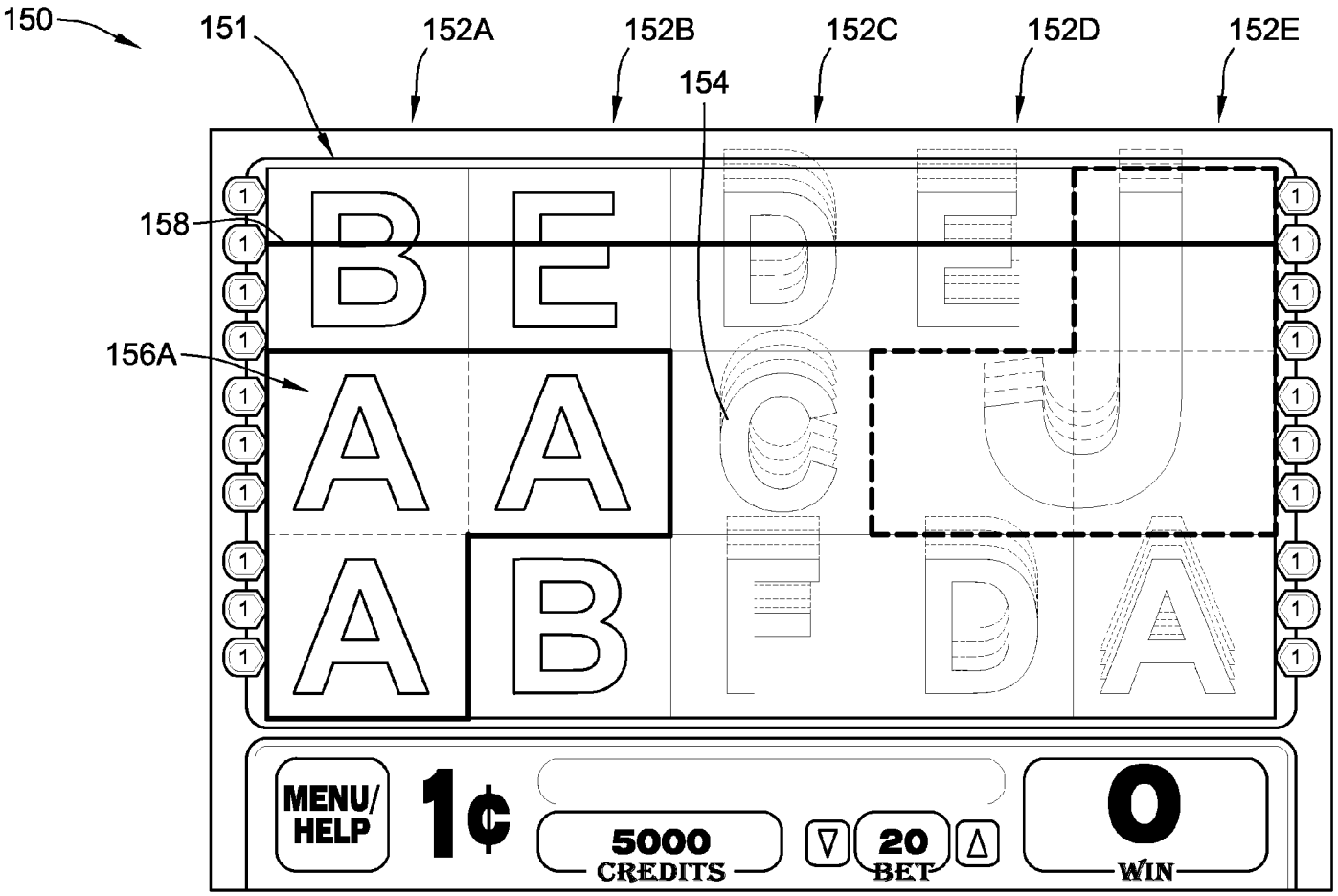
FIG. 4B is an image of the game screen of FIG. 4A with two reels stopped.
Figure 4C:
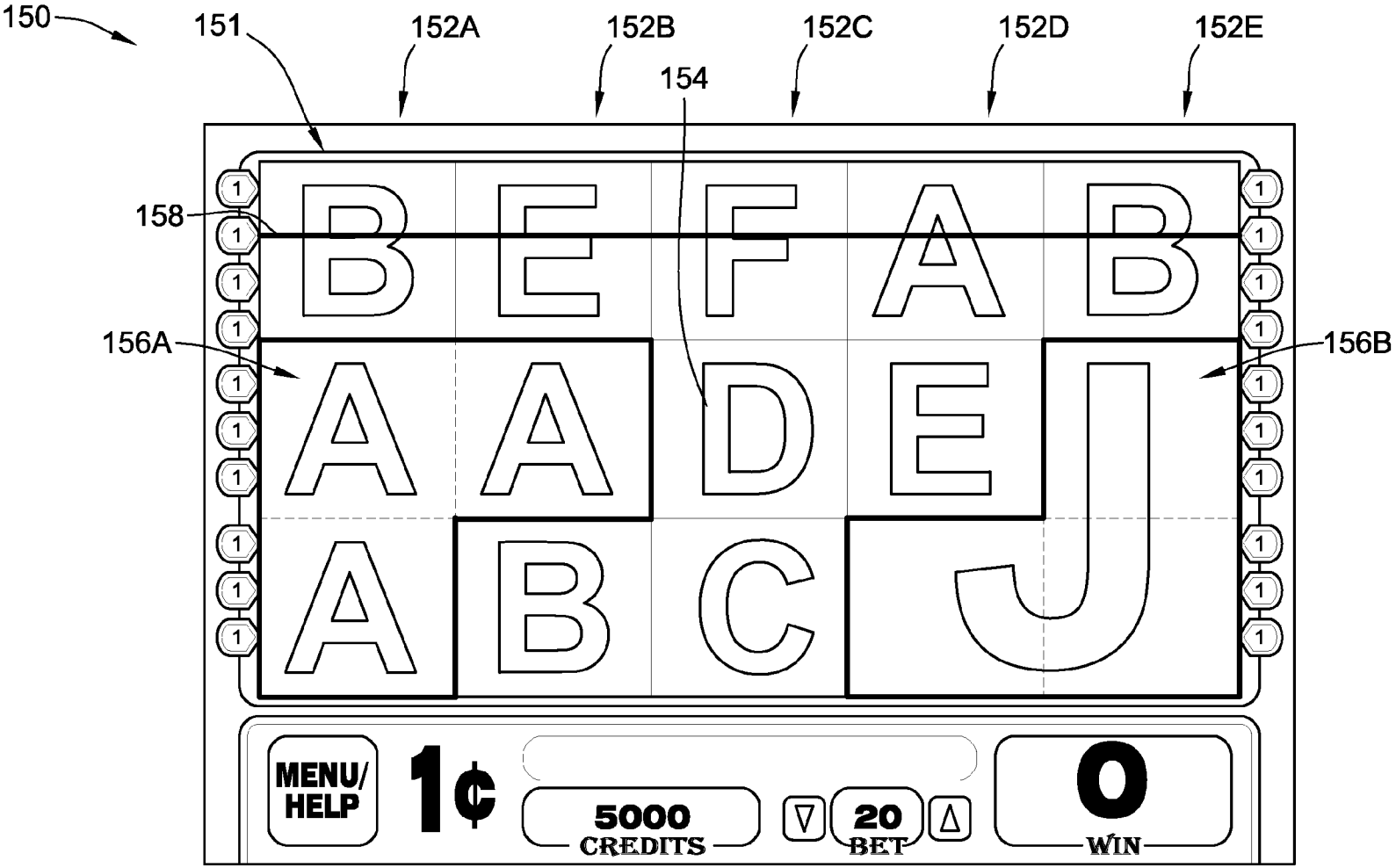
FIG. 4C is an image of the game screen of FIG. 4A with all reels stopped.

In another example, in reference to FIG. 4A, a second extended symbol 156B on the fifth reel 152E is currently moving generally through two positions: (a) the top position of the fifth column of the array 151, and (b) the top position of the adjacent fourth column of the array 151. The second extended symbol has a single "J" image that visually overlaps, currently, both positions. Thus, in contrast to the three, smaller images of the first extended symbol 156A, the image of the second extended symbol is a single, larger image. Eventually, as shown in FIG. 4C, the second extended symbol 156B is randomly selected to stop and visually overlap (a) the middle position of the fifth column of the array 151, (b) the bottom position of the fifth column of the array 151, and (c) the bottom position of the adjacent fourth column of the array 151.

The extended symbols 156A, 156B are visually overlapping the respective adjacent reels as the symbols are spinning through the display area (FIG. 4A). In other words, to further increase player excitement, the visual overlapping of the extended symbols 156A, 156B is displayed prior to stopping the motion of the respective ones of the first reel 152A (FIG. 4B) and the fifth reel 152E (FIG. 4C). In one example, the visually overlapping of the first extended symbol 156A is displayed throughout the spinning of the first reel 152A, from initiation of the spin to stopping of the spin.

Additionally, the visually overlapping of the extended symbols 156A, 156B occurs without affecting the stopping position of adjacent reels. In other words, the reels 152A-152E start and stop spinning independently of each other. For example, the second reel 152B spins independently of the first reel 152A and stops in the same position it would have stopped if the extended symbol 156A was replaced on the first reel 152A with two symbols 154. Similarly, in another example, the fourth reel 152D spins independently of the fifth reel 152E.

Figure 4D:
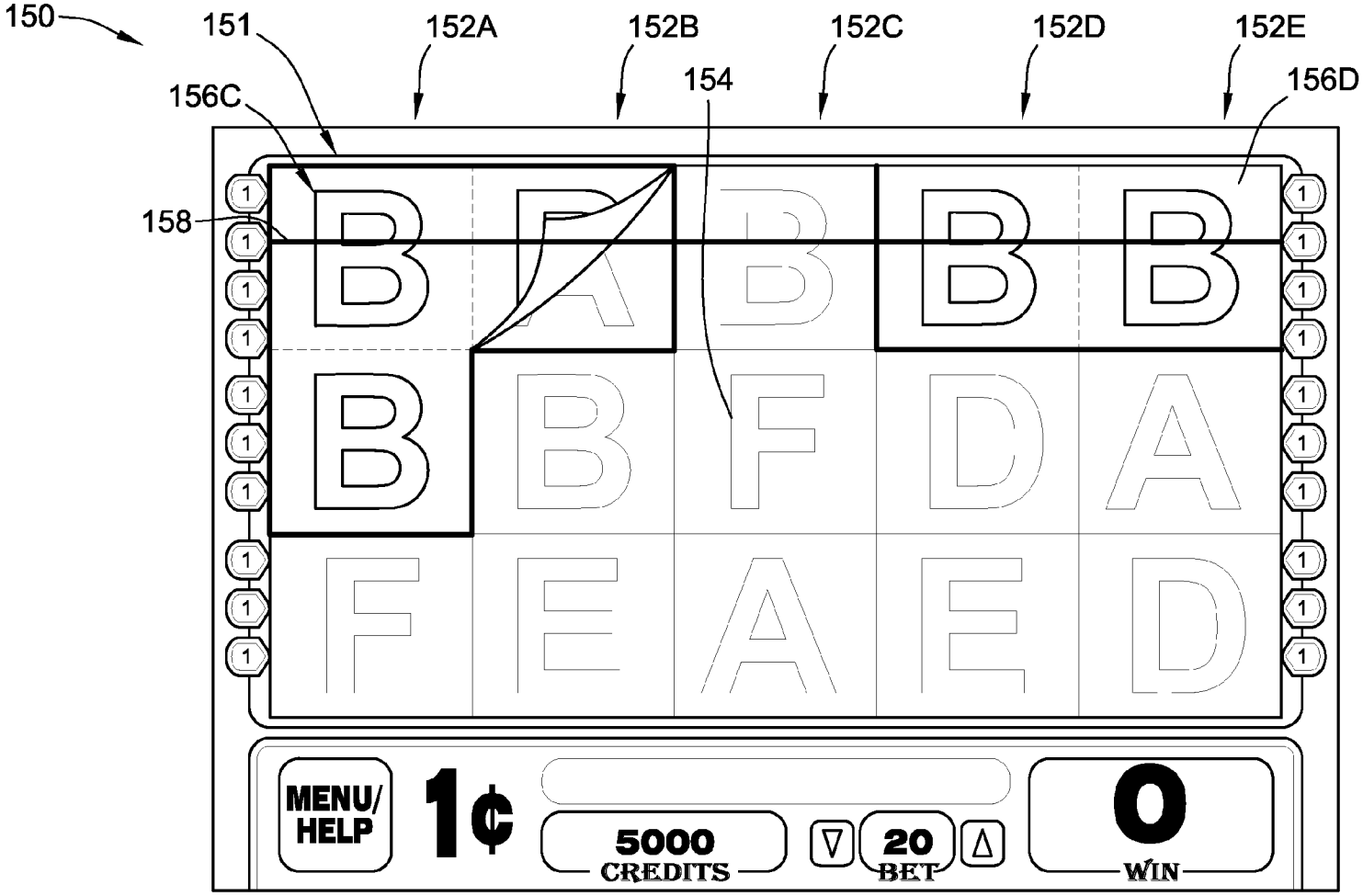
FIG. 4D is an image of the game screen of FIG. 4C illustrating an overlapped symbol.

In reference to FIG. 4D, a peel-away illustration shows a third extended symbol 156C overlapping an "A" symbol. The third extended symbol 156C is indexed on the first reel 152A and has three "B" Symbols—a first "B" symbol in the first row-first column of the array 151; a second "B" symbol in the first row-second column of the array 151; and a third "B" symbol in the second row-first column of the array 151. The overlapped "A" symbol is positioned in the first row-second column of the array 151, and is overlapped by the second "B" symbol of the third extended symbol 156C. Thus, the overlapped "A" symbol is covered by the second "B" symbol. Furthermore, the third extended symbol 156C supersedes any functions of the overlapped "A" symbol. For example, assuming that the "A" symbol had one or more functions selected from a group of Wilds, Multipliers, Scatters, etc., those functions would be superseded by the functions of the third extended symbol 156C. As such, an extended symbol supersedes any function of an overlapped symbol that would otherwise be spinning through the respective overlapped array position.

In determining a winning combination, an evaluation is performed based on the displayed combination of symbols 154 and any extended symbols coming to rest in the array 151. For example, as illustrated in FIG. 4D, an evaluation along a payline 158 will be based on the function of the third extended symbol 156C (which has "B" symbols extending across both the first and second columns of the array 151), the function of the "B" symbol in the third reel 152C, and the function of a fourth extended symbol 156D (which has "B" symbols extending across both the fourth and fifth columns of the array 151). This evaluation can result in a five-symbol winning combination being awarded if the player is playing the payline 158, which spans the top row of the array 151.

Figure 5B:
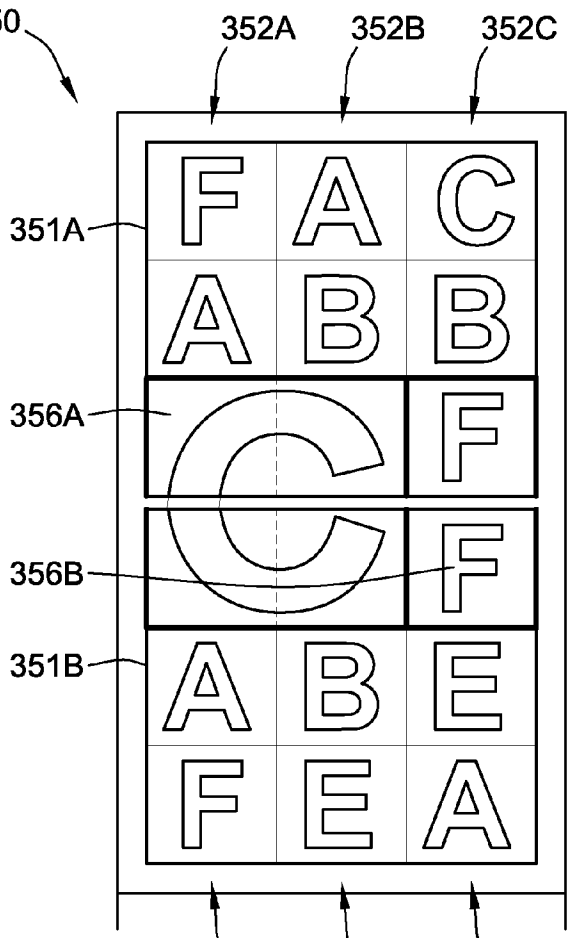
FIG. 5B is an image of a game screen illustrating a top-bottom array configuration.
Figure 5A:
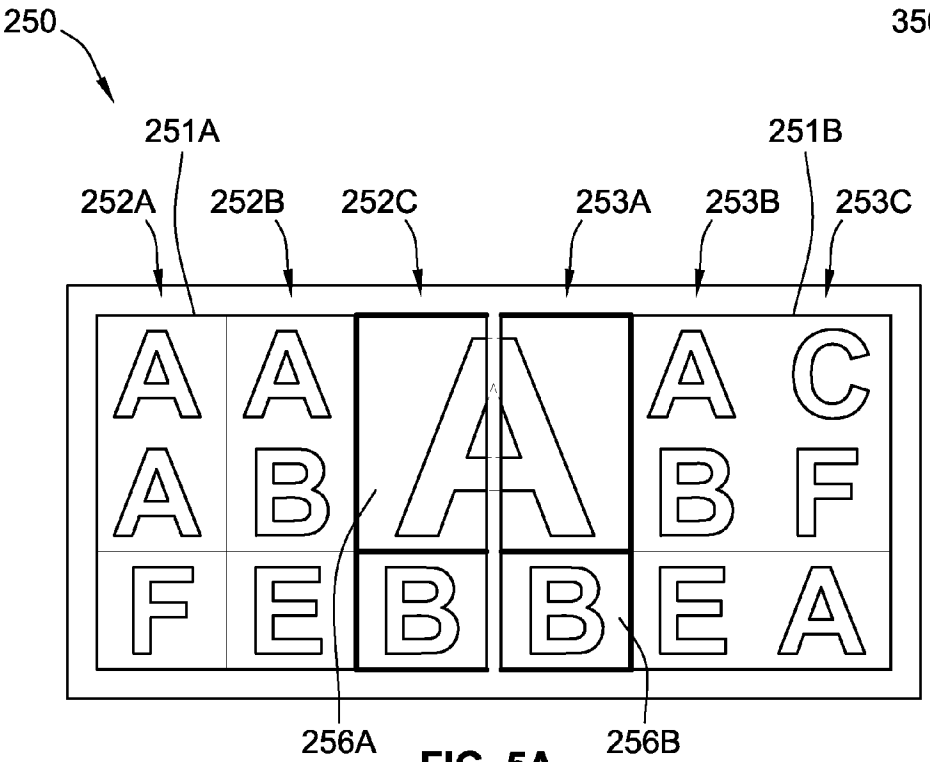
FIG. 5A is an image of a game screen illustrating a side-by-side array configuration.

Referring to FIGS. 5A and 5B, images of game screens 250, 350 are adapted to display other exemplary embodiments of extended symbols that are visually overlapping between adjacent reels of adjacent arrays of reels, including side-by-side configurations and top-bottom configurations. For example, in FIG. 5A a side-by-side configuration includes a left array 251A and a right array 251B. The left array 251A has three reels 252A-252C and the right array 251B has three reels 253A-253C. A first extended symbol 256A is visually overlapping top and middle positions of a third column of the left array 251A and an adjacent first column of the right array 251B. The first extended symbol 256A is controlled by either the third reel 252C or the first reel 253A. In this example, the first extended symbol 256A is a single, large image of an "A" symbol.

A second extended symbol 256B is visually overlapping bottom positions of the third column of the left array 251A and the adjacent first column of the right array 251B. Similarly to the first extended symbol 256A, the second extended symbol 256B is controlled by either the third reel 252C or the first reel 253A. In this example, the second extended symbol 256B includes two individual images of a "B" symbol.

In FIG. 5B, a top-bottom configuration includes a top array 351A and a bottom array 351B, each of the arrays having a respective set of three reels 352A-352C, 353A-353C. A first extended symbol "C" 356A is visually overlapping the bottom positions of first and second columns of the top array 351A and adjacent top positions of the first and second columns of the bottom array 351B. A second extended symbol "F" 356B is visually overlapping the bottom position of the third column of the top array 351A and the adjacent top position of the third column of the bottom array 351B.

Figure 6:
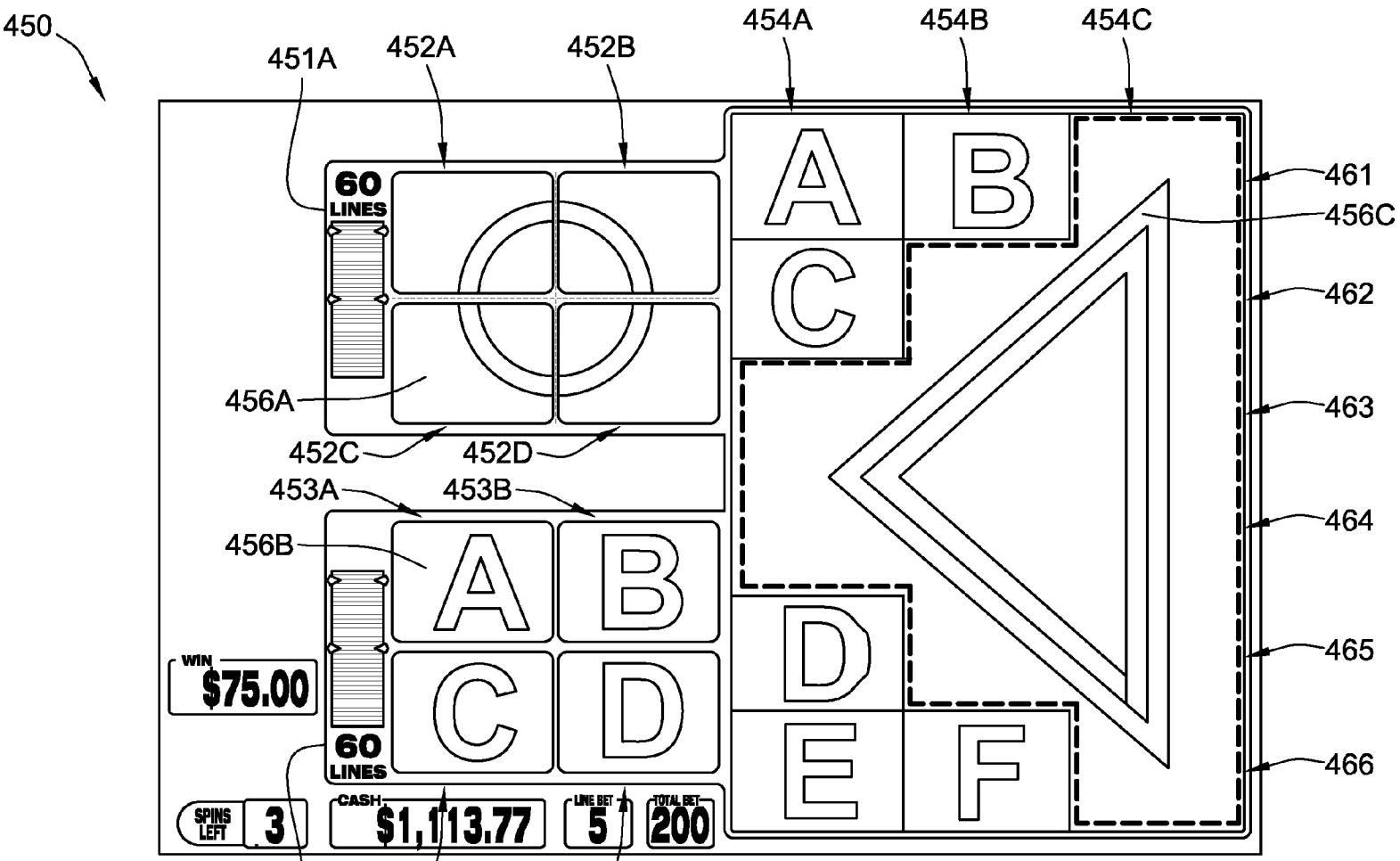
FIG. 6 is an image of a game screen illustrating a mixed-reel array configuration.

Referring to FIG. 6, an image of a game screen 450 is adapted to display a mixed-reel array configuration including a first independent array 451A and a second independent array 451B. Each of these arrays, which are evaluated on each reel spin, includes four individual reels 452A-452D, 453A-453D that are arranged in a two-by-two manner on the left side of the game screen 450. Furthermore, each evaluation of the arrays includes evaluating certain positions of three common reels 454A-454C located on right side of the game screen 450. The common reels 454A-454C include a first common reel 454A, a second common reel 454B, and a third common reel 454C. Each of the common reels 454A-454C has six positions arranged in respective rows, which include a first row 461, a second row 462, a third row 463, a fourth row 464, a fifth row 465, and a sixth row 466.

The evaluation of the first array 451A includes, in addition to evaluating the respective individual reels 452A-452D, evaluating the top four rows 461-464 of the common reels 454A-454C. The evaluation of the second array 451B includes, in addition to evaluating the respective individual reels 453A-453D, evaluating the bottom four rows 463-466 of the common reels 454A-454C. As such, the top first and second rows 461, 462 are only evaluated for the first array 451A, the bottom fifth and sixth rows 465, 466 are only evaluated for the second array 451B, and the middle third and fourth rows 463, 464 are evaluated for both arrays 451A, 451B.

Two extended symbols 456A, 456B are illustrated in the individual reels 452A-452D, 453A-453D and the common reels 454A-454C. For example, a first extended symbol 456A in the shape of a "Circle" is illustrated visually overlapping all four individual reels 452A-452D of the first array 451A. A second extended symbol 456B in the shape of a "Triangle" is illustrated visually overlapping numerous positions of the common reels 454A-454C. The second extended symbol 456B is indexed in the third common reel 454C and extends to the left to overlap symbols in both the adjacent second common reel 454B and the next-adjacent first common reel 454A. Specifically, the second extended symbol 456B visually overlaps (a) the third and fourth rows 463, 464 of the first common reel 454A, (b) the second, third, fourth, and fifth rows 462-465 of the second common reel 454B, and (c) all the rows 461-466 of the third common reel 454C.

The extended symbols 456A, 456B can be designed in such a configuration to control near-misses, which are generally outcomes in which a winning combination is almost achieved by, for example, having only one missing symbol from a complete winning combination. For example, having an extended symbol overlapping a larger number of adjacent positions will generally decrease the number of near-misses, while having an extended symbol overlapping a smaller number of adjacent positions will generally increases the number of near-misses. Similar to near-misses, in another example, the extended symbols 456A, 456B can be designed in such a configuration to control volatility, either increasing or decreasing the volatility depending on the selected shape of the extended symbol.

By having the second extended symbol 456B indexed on the third common reel 454C, which is the rightmost reel and typically the last reel to stop spinning, player suspense is built right up until all the reels stop spinning. As the reels spin and stop, sequentially, the player does not know whether he or she will receive a valuable symbol or symbols until all the reels have stopped spinning. The second extended symbol 456B is such a valuable symbol because it has the potential to change the randomly selected outcome displayed on the reel from being a non-winning outcome to being a winning outcome. The second extended symbol 456B extends backwards, towards already-stopped reels, to possibly result in an improved outcome. As such, an extended symbol indexed in the last stopped reel can maintain hope and excitement for the player until the very end of the spin.

In an alternative embodiment, an extended (or oversized) symbol is presented on a transmissive display in which a video image is superimposed over a set of mechanical reels. Typically, the transmissive display is positioned directly in front of the mechanical reels and generates a direct image. In such an arrangement, the transmissive display may be a flat panel transmissive video display, for example, a transmissive liquid crystal display (LCD) panel commercially available from LG Phillips LCD Co., Ltd., of Seoul, Korea, Sharp Electronics Corp. of Tokyo, Japan, and other display manufacturers. The flat panel transmissive video display is preferably preconfigured with a touch screen mounted to a front surface of the display. The transmissive display can use either a reflected video image or a direct video image.

The transmissive LCD panel is intended to appear more like a traditional mechanical reel game, but with added enhancements. For example, one enhancement is related to the display of meters (such as credit meter 54 in FIG. 3). A traditional game typically uses 7-segment light-emitting diode (LED) displays behind a glass to display amounts (e.g., win amounts, bet amounts, credit amounts, etc.). Current games use various fonts to display the amounts on the transmissive LCD panel. To display similar fonts on a traditional mechanical game, actual images (or photographs) of an illuminated 7-segment LED display can be displayed as the fonts in a transmissive LCD panel.

For example, 12 images are made to cover basic numeric display requirements, including the nine digits (0-9), the "dot" symbol (.), and a blank space. Referring to FIG. 3, the images can cover any combination of amounts, including, for example, the displaying of the "702" credits in credit meter 54. Additional images can be loaded as necessary for non-numeric uses. The images can be created by professionally photographing actual meters on a non-transmissive mechanical reel game with appropriate display segments being illuminated. Optionally, images of individual display segments can be made, which would only require seven smaller images per digit.

Each of these embodiments and obvious variations thereof is contemplated as falling within the spirit and scope of the claimed invention, which is set forth in the following claims.

What is claimed is:

1. A gaming system primarily dedicated to playing at least one casino wagering game, the gaming system comprising:

a gaming machine including one or more electronic input devices and one or more electronic display devices; and one or more controllers configured to:

detect, via at least one of the one or more electronic input devices, a physical item associated with a monetary value that establishes a credit balance shown on a credit meter displayed by at least one of the one or more electronic display devices;

initiate the casino wagering game in response to an input indicative of a wager covered by the credit balance;

determine a randomly generated outcome of the casino wagering game;

direct at least one of the one or more electronic display devices to display a first array comprising a plurality of symbol positions, each of the symbol positions being populated by a symbol that spins and stops with one of a plurality of symbol-bearing reels, the plurality of symbol-bearing reels including at least a first reel, the first reel including at least one extended symbol that spins and stops with the first reel, and to display a second array of symbol-bearing reels adjacent to the first array;

direct at least one of the one or more electronic display devices to spin and stop the symbol-bearing reels to place symbols on the symbol-bearing reels in visual association with the symbol positions of the first and second arrays, the at least one extended symbol on the first reel visually overlapping one or more symbols on the adjacent second array (a) as the first reel spins the extended symbol through the first array and (b) without affecting a stopping position of a reel of the adjacent second array, and award an award for any winning combinations defined by the symbols displayed on the first and second arrays, the award having a credit value that is added to the credit balance.

2. The gaming system of claim 1, wherein the at least one extended symbol supersedes functions of the one or more symbols on the adjacent second array.

3. The gaming system of claim 1, wherein the at least one extended symbol is displayed when the spin of the symbol-bearing reels is initiated.

4. The gaming system of claim 1, wherein the at least one extended symbol is displayed overlapping at least two symbol positions on the second array.

5. The gaming system of claim 1, wherein the winning combinations are determined based on the at least one extended symbol and any non-overlapped symbols of the symbols displayed in the first and second arrays.

6. The gaming system of claim 1, wherein the plurality of symbol-bearing reels of the first array further includes a second extended symbol that spins and stops with a second reel distinct from the first reel, the second extended symbol visually overlapping one or more symbols on the adjacent second array (a) as the second reel spins the second extended symbol through the second array and (b) without affecting a stopping position of a reel of the second array.

7. The gaming system of claim 1, wherein the first array of symbol-bearing reels is displayed in a side-by-side configuration with the second array of symbol-bearing reels.

8. The gaming system of claim 1, wherein first the array of symbol-bearing reels is displayed in a top-bottom configuration with the second array of symbol-bearing reels.

9. A method of operating a gaming system primarily dedicated to playing at least one casino wagering game, the gaming system one or more controllers and a gaming machine, the gaming machine including one or more electronic display devices, and one or more electronic input devices, the method comprising:

detecting, by at least one of the one or more electronic input devices, a physical item associated with a monetary value that establishes a credit balance shown on a credit meter displayed by at least one of the one or more electronic display devices;

initiating the casino wagering game in response to an input indicative of a wager covered by the credit balance;

displaying, on at least one of the one or more electronic display devices, a first array comprising a plurality of symbol positions, each of the symbol positions being populated by a symbol that spins and stops with one of a first plurality of symbol-bearing reels, the first plurality of symbol-bearing reels including at least a first reel, the first reel including at least one extended symbol that spins and stops with the first reel, and a second array distinct from the first array, the second array including a second plurality of symbol-bearing reels;

spinning and stopping, by one or more controllers, the symbol-bearing reels to place symbols representing the outcome on the symbol-bearing reels in visual association with the symbol positions of the first and second arrays, the at least one extended symbol on the first reel visually overlapping one or more symbols on the second array (a) as the first reel spins the extended symbol through the first array and (b) without affecting a stopping position of a reel of the second array; and awarding, by at least one of the one or more controllers, an award for any winning combinations defined by the symbols displayed on one or both of the first and second arrays, the award having a credit value that is added to the credit balance.

10. The method of claim 9, wherein the at least one extended symbol supersedes functions of the one or more symbols on the second array.

11. The method of claim 9, further comprising displaying the at least one extended symbol when the spin of the symbol-bearing reels is initiated.

12. The method of claim 9, wherein the at least one extended symbol is displayed overlapping at least two symbol positions of the second array.

13. The method of claim 9, further comprising determining winning combinations based on the at least one extended symbol and any non-overlapped symbols of the symbols displayed on the first and second arrays.

14. The method of claim 9, wherein the first plurality of symbol-bearing reels of the first array further includes a second extended symbol that spins and stops with a second reel distinct from the first reel, the second reel being the rightmost reel of the first plurality, the second extended symbol visually overlapping one or more symbols on the second array (a) as the second reel spins the second extended symbol through the first array and (b) without affecting a stopping position of a reel of the second array.

15. The method of claim 9, further comprising displaying the first array of symbol-bearing reels in a side-by-side configuration with the second array of symbol-bearing reels.

16. The method of claim 9, further comprising displaying the first array of symbol-bearing reels in a top-bottom configuration with the second array of symbol-bearing reels.

17. One or more machine-readable non-transitory storage media including instructions which, when executed by a gaming system including one or more controllers and a gaming machine, the gaming machine including one or more electronic display devices and one or more electronic input devices, cause the one or more controllers to perform operations comprising:

detecting, by at least one of the one or more electronic input devices, a physical item associated with a monetary value that establishes a credit balance shown on a credit meter displayed by at least one of the one or more electronic display devices;

initiating the casino wagering game in response to an input indicative of a wager covered by the credit balance;

displaying, on at least one of the one or more electronic display devices, a first array comprising a plurality of symbol positions, each of the symbol positions being populated by a symbol that spins and stops with one of a first plurality of symbol-bearing reels, the first plurality of symbol-bearing reels including at least a first reel and a second reel, the first reel including at least one extended symbol that spins and stops with the first reel, and a second array distinct from the first array, the second array including a second plurality of symbol-bearing reels;

spinning and stopping the symbol-bearing reels to place symbols on the symbol-bearing reels in visual association with the symbol positions of the first and second arrays, the at least one extended symbol on the first reel visually overlapping one or more symbols on the second array (a) as the first reel spins the extended symbol through the first array and (b) without affecting a stopping position of a reel of the second array; and awarding an award for any winning combinations defined by the symbols displayed on one or both of the first and second arrays, the award having a credit value that is added to the credit balance.

18. The machine-readable non-transitory storage media of claim 17, wherein the at least one extended symbol supersedes functions of the one or more symbols on the second array.

19. The machine-readable non-transitory storage media of claim 17, the operations further comprising displaying the at least one extended symbol when the spin of the symbol-bearing reels is initiated.

20. The machine-readable non-transitory storage media of claim 17, wherein the first plurality of symbol-bearing reels of the first array further includes a second extended symbol that spins and stops with a second reel distinct from the first reel, the second extended symbol visually overlapping one or more symbols on the second array (a) as the second reel spins the second extended symbol through the first array and (b) without affecting a stopping position of a reel of the second array.

* * * * *